US011504563B2

(12) United States Patent
Srihari et al.

(10) Patent No.: US 11,504,563 B2
(45) Date of Patent: Nov. 22, 2022

(54) MINI-TRAMPOLINE

(71) Applicant: Pure Global Brands, Inc., Mesquite, TX (US)

(72) Inventors: Swastic Srihari, Addison, TX (US); Zorin Abraham, Sunnyvale, TX (US); Kinsey Harris, West Palm Beach, FL (US)

(73) Assignee: Pure Global Brands, Inc., Mesquite, TX (US)

( * ) Notice: Subject to any disclaimer, the term of this patent is extended or adjusted under 35 U.S.C. 154(b) by 38 days.

(21) Appl. No.: 17/164,971

(22) Filed: Feb. 2, 2021

(65) Prior Publication Data

US 2021/0244990 A1 Aug. 12, 2021

Related U.S. Application Data

(60) Provisional application No. 62/970,761, filed on Feb. 6, 2020.

(51) Int. Cl.
*A63B 5/11* (2006.01)
*A63B 21/00* (2006.01)

(52) U.S. Cl.
CPC ..... *A63B 5/11* (2013.01); *A63B 21/4035* (2015.10); *A63B 2225/093* (2013.01)

(58) Field of Classification Search
CPC .... A63B 5/00; A63B 5/08; A63B 5/10; A63B 5/11; A63B 5/16; A63B 2005/085; A63B 21/00047; A63B 21/0005; A63B 21/00054; A63B 21/00058; A63B 21/00076; A63B 21/00185; A63B 21/02; A63B 21/023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/4027; A63B 21/4033; A63B 21/4034; A63B 21/4035; A63B 26/00; A63B 26/003; A63B 69/0057; A63B 71/0054; A63B 2071/0063; A63B 2071/0072;

(Continued)

(56) References Cited

U.S. PATENT DOCUMENTS 3,667,316 A * 6/1972 Valletti ..... G05G 1/60 74/560
4,225,131 A * 9/1980 Sidlinger ..... A63B 23/0211 482/27

(Continued)

FOREIGN PATENT DOCUMENTS

DE 202008011910 U1 * 3/2010 ..... A63B 5/11

*Primary Examiner* — Gary D Urbiel Goldner
(74) *Attorney, Agent, or Firm* — Scott Griggs; Griggs Bergen LLP

(57) ABSTRACT

A mini-trampoline is disclosed. In one embodiment, a base support frame is circumferentially offset from a trampoline mat. The base support frame includes a horizontal support frame with vertical support members extending subjacently therefrom. Resilient members circumextend from the trampoline mat to the horizontal support frame. Each of the vertical support members includes a suction cup having a suction cup locking mechanism at a lower end. A support assembly is secured to the base support frame and includes a T-shaped support bar having handles cantilevering toward the trampoline mat.

7 Claims, 9 Drawing Sheets

(58) Field of Classification Search
CPC .... A63B 2208/0204; A63B 2208/0209; A63B 2225/05; A63B 2225/055; A63B 2225/09; A63B 2225/093
See application file for complete search history.

(56) References Cited

U.S. PATENT DOCUMENTS 4,337,942 A * 7/1982 Sidlinger ..... A63B 23/0211 482/145
4,598,905 A * 7/1986 Vrana ..... A63B 5/11 482/27
5,374,225 A * 12/1994 Wilkinson ..... A63B 23/03533 482/29
5,533,948 A * 7/1996 Wilkinson ..... A63B 22/0012 482/52
5,607,377 A * 3/1997 Wilkinson ..... A63B 69/20 482/30
5,634,870 A * 6/1997 Wilkinson ..... A63B 23/1263 482/52
5,645,510 A * 7/1997 Wilkinson ..... A63B 21/0552 482/52
5,674,157 A * 10/1997 Wilkinson ..... A63B 69/20 482/83
8,157,713 B1 * 4/2012 Siskowic ..... A63B 21/0004 482/141
8,197,390 B2 6/2012 Ikegami
8,430,795 B2 4/2013 Publicover et al.
9,180,328 B2 11/2015 Shaffer et al.
D758,515 S * 6/2016 Tsai ..... A63B 22/0012 D21/797
9,707,426 B2 * 7/2017 Tsai ..... A63B 5/11
D805,595 S 12/2017 Chen
10,076,697 B1 9/2018 Publicover et al.
D853,507 S * 7/2019 Hammer ..... A63B 23/0211 D21/797
D884,103 S * 5/2020 Hammer ..... G05G 1/60 D21/797
2005/0043142 A1 2/2005 Rieber
2012/0115693 A1 * 5/2012 Franques ..... A63B 23/0211 482/140
2017/0216648 A1 8/2017 Male
2018/0280750 A1 10/2018 Fischer et al.
2020/0009413 A1 * 1/2020 Berklund ..... F16B 47/006

* cited by examiner

MINI-TRAMPOLINE

PRIORITY STATEMENT & CROSS-REFERENCE TO RELATED APPLICATIONS

This application claims priority from U.S. Patent Application No. 62/970,761, entitled "Mini-Trampoline" and filed on Feb. 6, 2020, in the names of Swastic Srihari, et al.; which is hereby incorporated by reference, in entirety, for all purposes.

TECHNICAL FIELD OF THE INVENTION

This invention relates, in general, to trampolines and, in particular, to mini-trampolines that provide a rebounding area for a single person engaged in exercise or recreation.

BACKGROUND OF THE INVENTION

Mini-trampolines, also known as rebounders, exercise trampolines, or trampettes, typically have smaller diameters and are closer to the ground than traditional, recreational, or competitive trampolines. Such mini-trampolines are often utilized indoors as part of a physical fitness regime, as "rebounding" on a mini-trampoline provides a form of exercise with a low impact on knees and other joints. Mini-trampolines have, therefore, become popular with people of various ages and physical abilities. Accordingly, a need exists for mini-trampolines that provide increased accessibility before and after use as well as increased stabilization during use.

SUMMARY OF THE INVENTION

It would be advantageous to achieve a mini-trampoline that offers safeguards to people of various ages and physical abilities. It would be desirable to enable a mechanical solution that furnishes an effective, compact, and easily storable device. It would be desirable to enable a mechanical solution that provides increased accessibility before and after use as well as increased stabilization during use. To better address one or more of these concerns, in one aspect of the invention, a mini-trampoline is disclosed. In one embodiment, a base support frame is circumferentially offset from a trampoline mat. The base support frame includes a horizontal support frame with vertical support members extending subjacently therefrom. Resilient members circumextend from the trampoline mat to the horizontal support frame. Each of the vertical support members includes a suction cup at the lower end. A support assembly is secured to the base support frame and includes a T-shaped support bar having handles cantilevering toward the trampoline mat.

In one implementation, each of the suction cups has a suction cup locking mechanism at the lower end. A lever is pivotally mounted to the base, and a linkage member extends between the lever and a location proximate the peripheral edge of the foot of the suction cup. In one levered position, a force is exerted by the linkage member to hold the peripheral edge of the foot of the suction cup against the surface. In another levered position, a force is exerted by the linkage member to draw the peripheral edge of the foot of the suction cup away from the surface to which it is adhering until the suction maintaining the suction cup in position is released. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
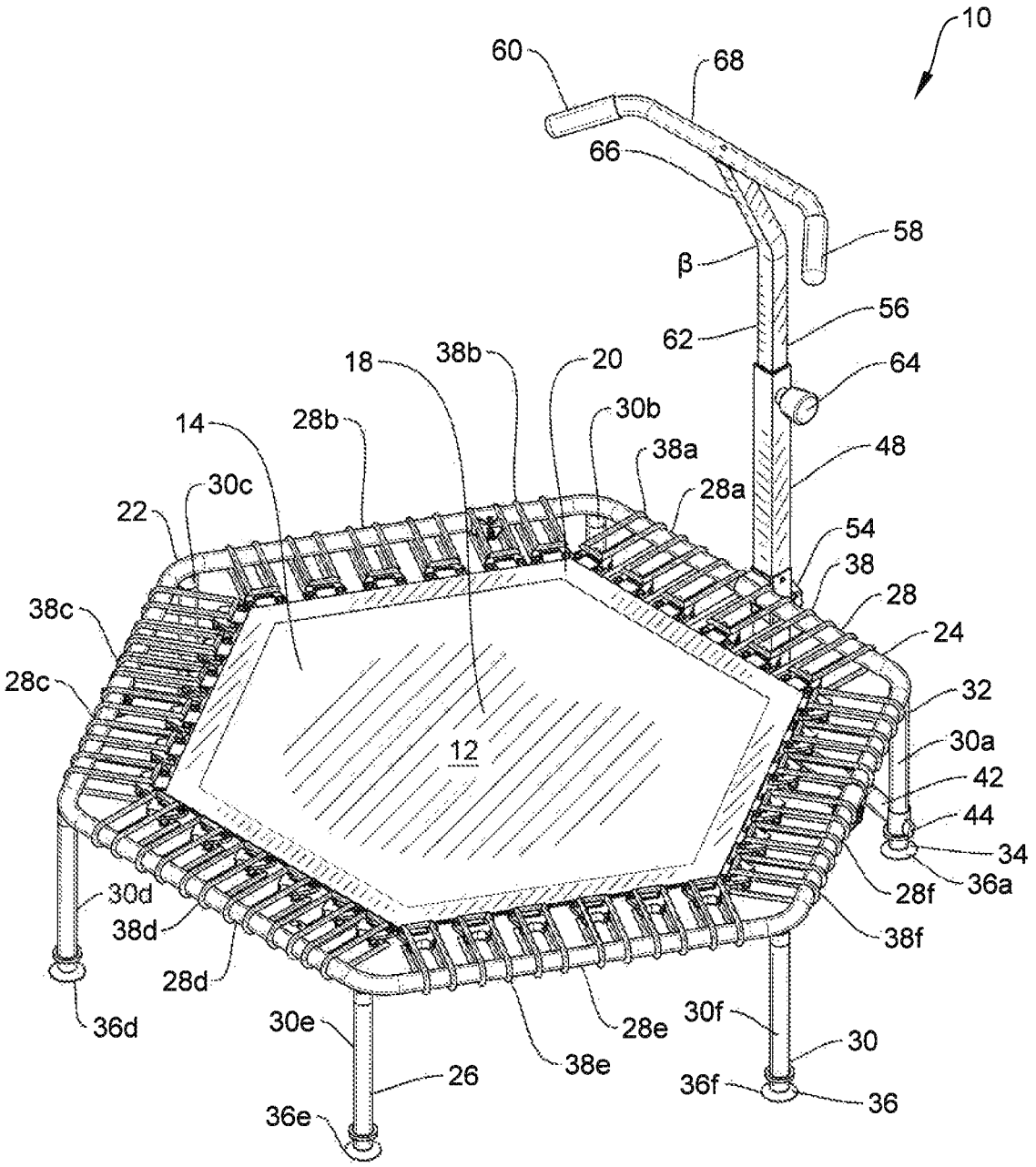
FIG. 1 is a front perspective view of one embodiment of a mini-trampoline, according to the teachings presented herein.
Figure 2:
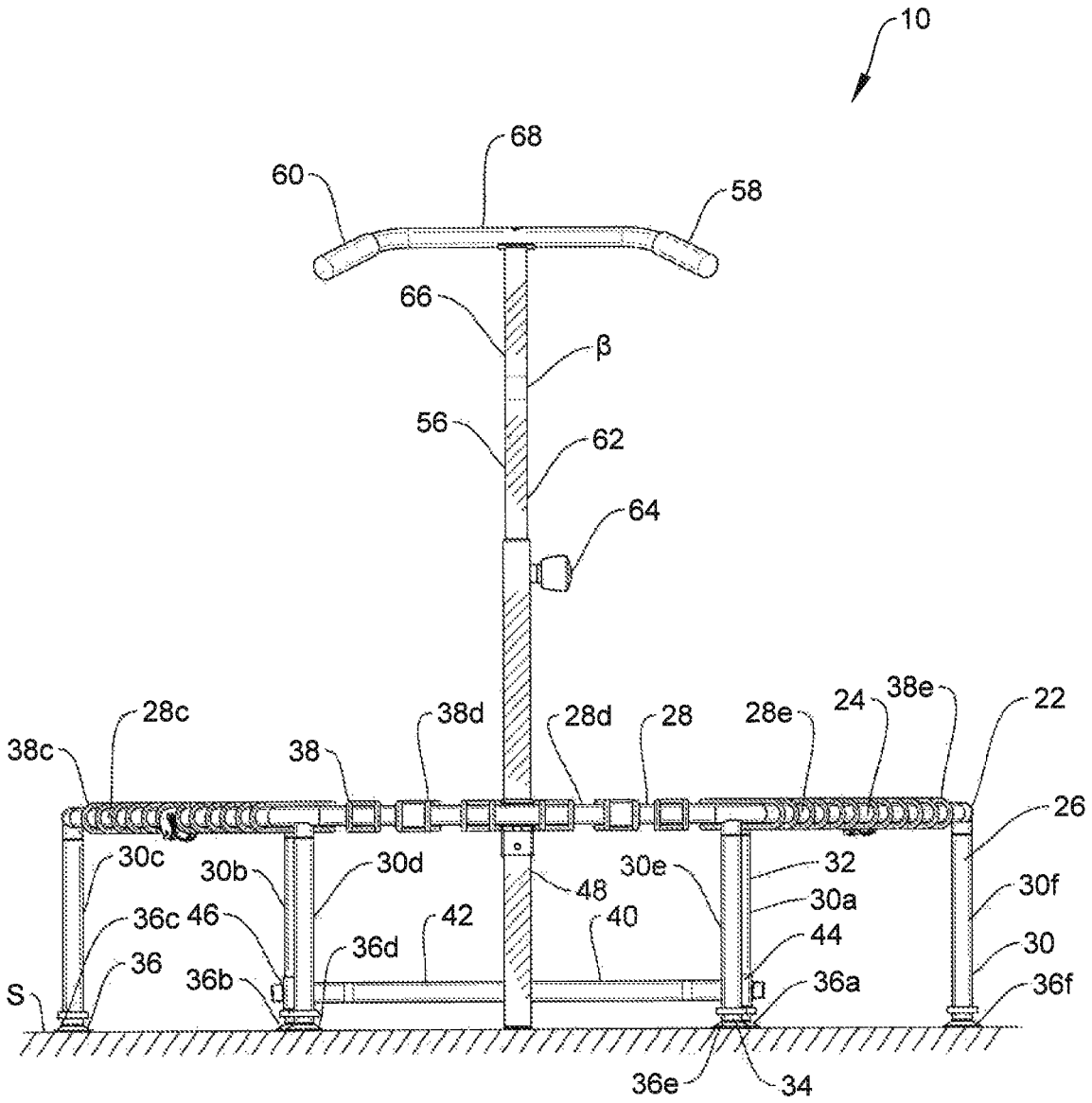
FIG. 2 is a front elevation view of the mini-trampoline presented in FIG. 1.
Figure 3:
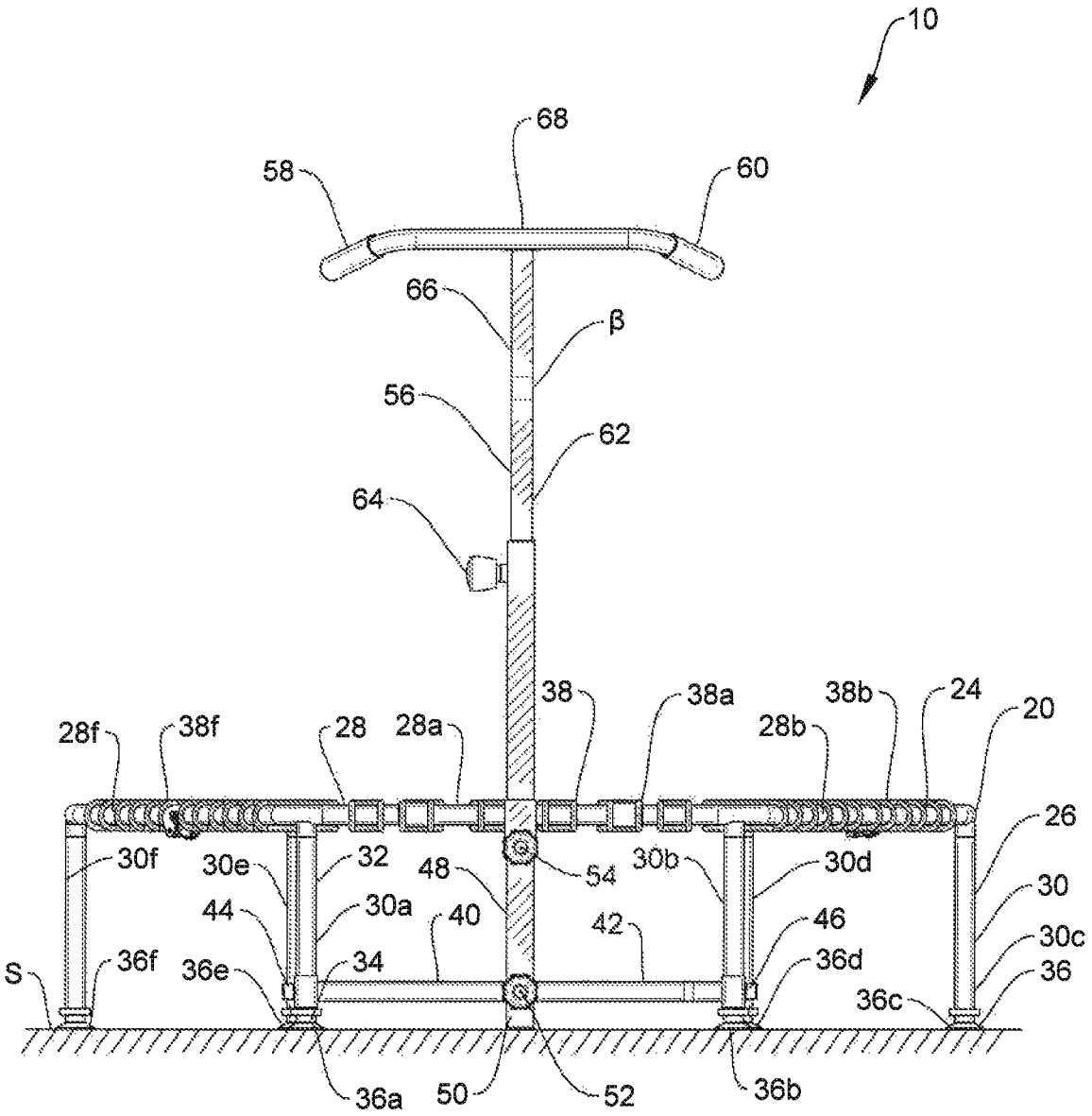
FIG. 3 is a rear elevation view of the mini-trampoline presented in FIG. 1.
Figure 4:
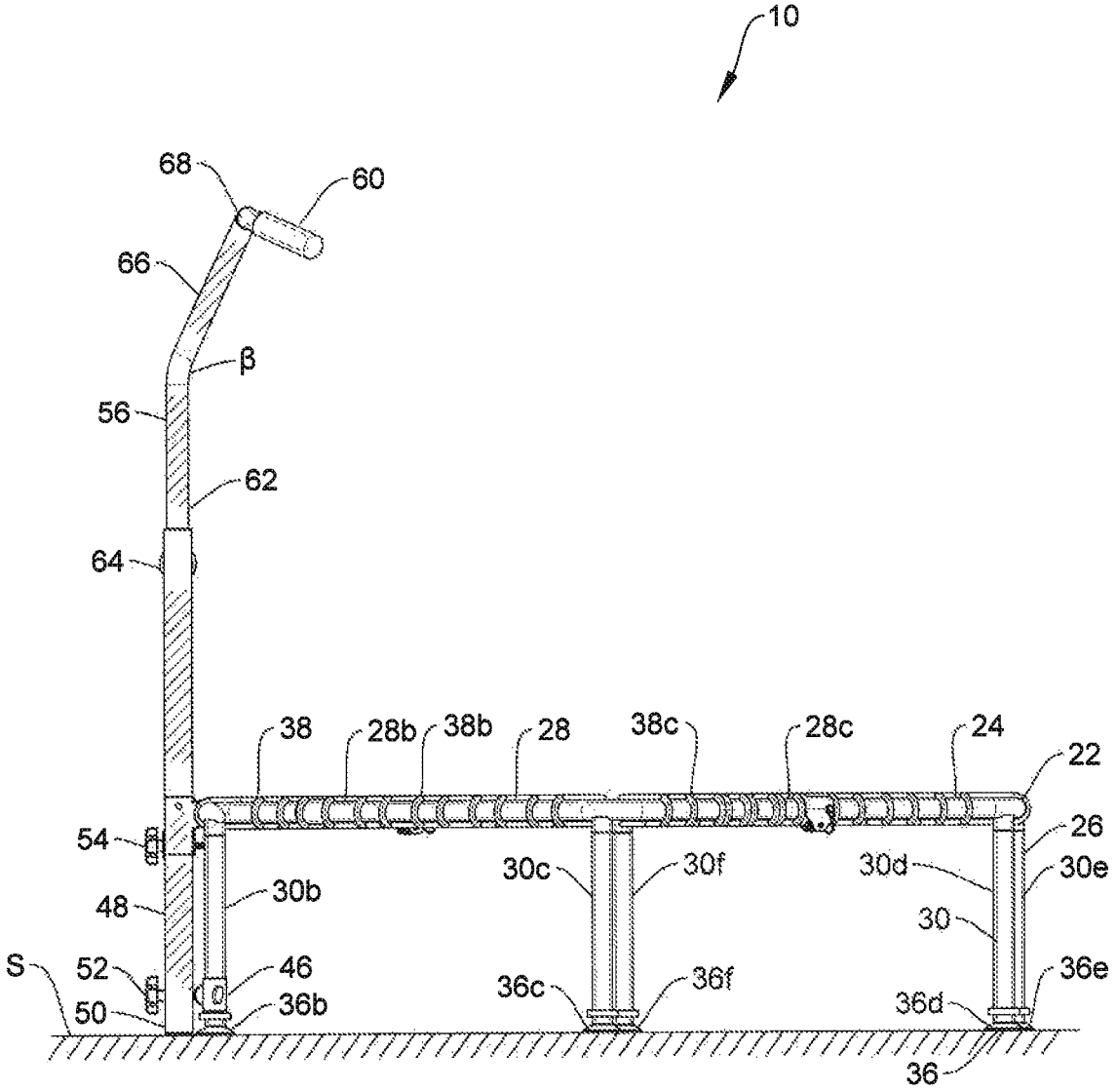
FIG. 4 is a left-side elevation view of the mini-trampoline presented in FIG. 1.
Figure 5:
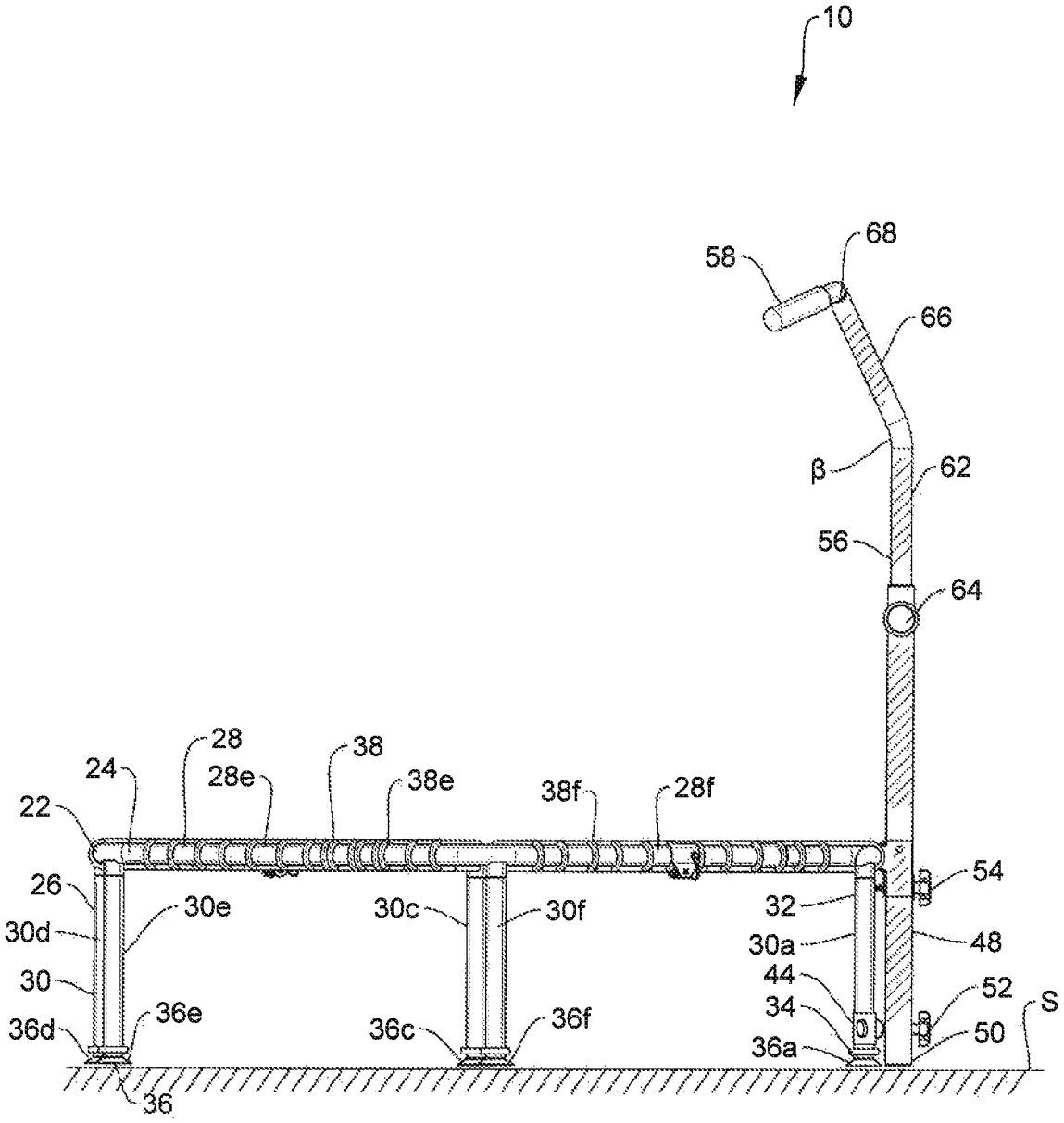
FIG. 5 is a right-side elevation view of the mini-trampoline presented in FIG. 1.
Figure 6:
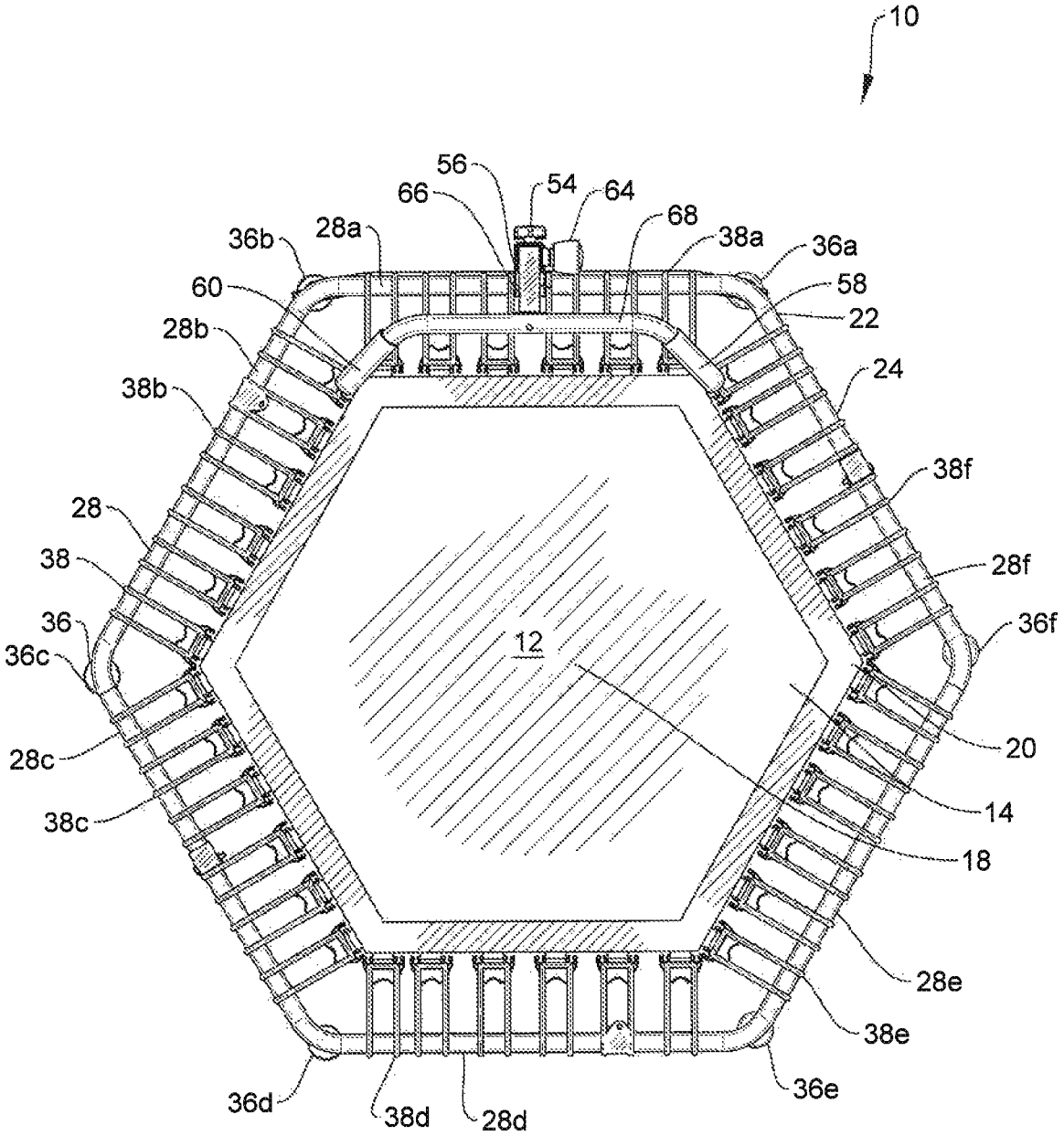
FIG. 6 is a top plan view of the mini-trampoline presented in FIG. 1.
Figure 7:
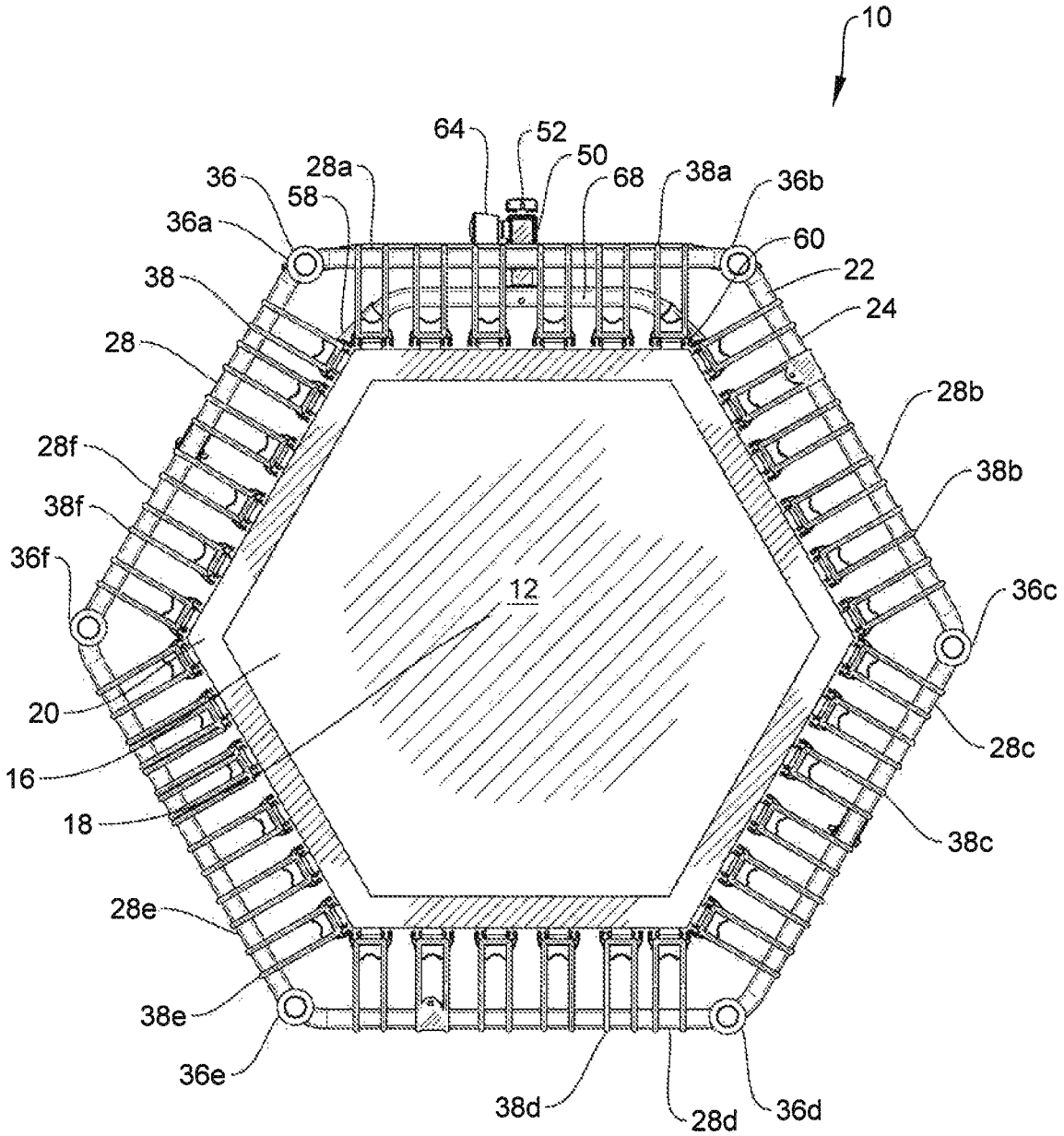
FIG. 7 is a bottom plan view of the mini-trampoline presented in FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1, FIG. 2, FIG. 3, FIG. 4, FIG. 5, FIG. 6, and FIG. 7, therein is depicted one embodiment of a mini-trampoline, which is schematically illustrated and generally designated 10. A trampoline mat 12 has an upper surface 14 and a lower surface 16 with a center 18 and a periphery 20. A base support frame 22 is circumferentially offset from the periphery 20 of the trampoline mat 12. In one embodiment, the base support frame 22 includes a horizontal support frame 24 and a vertical support frame 26. As shown, the horizontal support frame 24 may include horizontal support members 28, which are labeled horizontal support members 28*a*, 28*b*, 28*c*, 28*d*, 28*e*, and 28*f*. It should be appreciated, however, that although six (6) horizontal support members are depicted, any number of horizontal support members may be utilized. The vertical support frame 26 may include vertical support members 30, which are labeled vertical support members 30*a*, 30*b*, 30*c*, 30*d*, 30*e*, and 30*f*. As shown, with vertical support member 30*a* as an example, each of the vertical support members 30 have an upper end 32 and a lower end 34. Each of the vertical support members 30 at the upper end 32 are secured to the horizontal support frame 24. Each of the vertical support members 30 extend subjacently from the horizontal support frame 24 to a surface S. As will be discussed in greater detail hereinbelow, each of the vertical support members 30 include a suction cup 36 at the lower end 34. As shown, the suction cups are labeled 36*a*, 36*b*, 36*c*, 36*d*, 36*e*, and 36*f*.

Resilient members 38 circumextend from the periphery 20 of the trampoline mat 12 to the horizontal support frame 24. As depicted, six (6) sets of resilient members 38 are included, which are numbered resilient members 38*a*, 38*b*, 38*c*, 38*d*, 38*e*, and 38*f*. A support assembly 40 includes a crossbar 42 secured to the adjacent vertical support members 30*a*, 30*b* by couplings 44, 46. The crossbar 42 may be subjacent to the horizontal support frame 24. The support assembly 40 includes a support segment 48 extending vertically from the crossbar 42 and upwardly away from the horizontal support frame 24. The support segment 48 may include a foot 50 contacting the surface S and be coupled to the crossbar 42 with a hand knob assembly 52. The support segment 48 may be coupled to the horizontal support frame 24 by a hand knob assembly 54. The support assembly 40 also includes a T-shaped support bar 56 adjustably telescoping from the support segment 48 and cantilevering toward the trampoline mat 12.

The T-shaped support bar 56 includes handles 58, 60 coupled thereto. As shown, the T-shaped support bar 56 may also include a support bar member 62 configured to adjustably telescope from the support segment 48 and be coupled thereto by a hand knob assembly 64. A support bar member 66 extends from the support bar member 62 at an angle ß. The support bar member 66 may have a riser bar 68 secured thereat with handles 58, 60 coupled thereto. In one embodiment, as seen best in FIG. 6, the T-shaped support bar 56 spans from the vertical support member 30*a* to the adjacent vertical support member 30*b* proximately above the periphery 20 of the trampoline mat 12. As shown, the support assembly 40 may include at least three points of contact with the base support frame 22. In the illustrated embodiment, the support assembly 40 is secured to the vertical support members 30*a*, 30*b* by couplings 44, and secured to the horizontal support frame 24 by the hand knob assembly 54.

Figure 8:
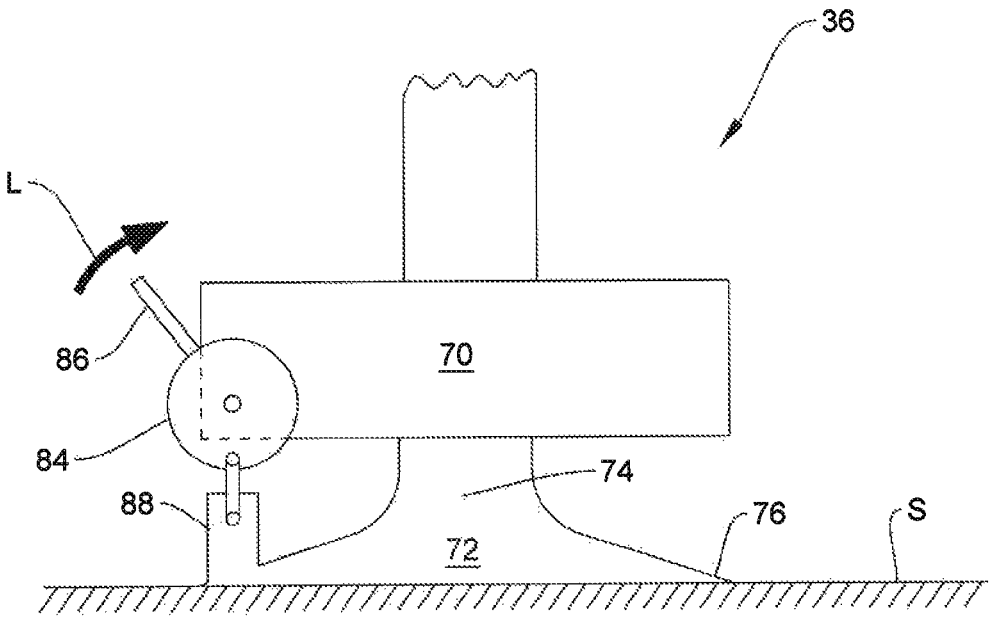
FIG. 8 is a front elevation view of a portion of the mini-trampoline presented in FIG. 1 with a suction cup locking mechanism in a suction cup hold position.
Figure 9:
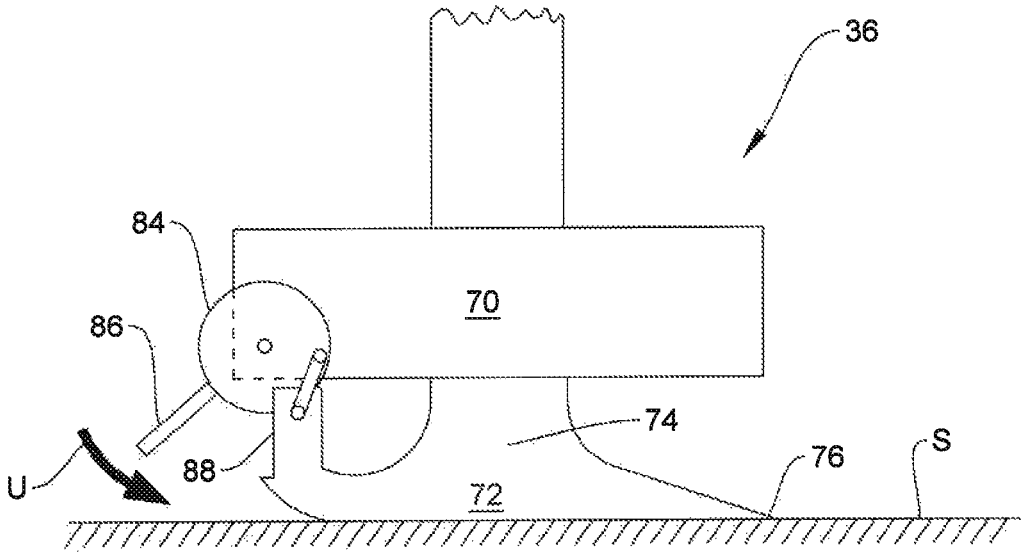
FIG. 9 is a front elevation view of a portion of the mini-trampoline presented in FIG. 1 with a suction cup locking mechanism in a suction cup release position.

Referring now to FIG. 8 and FIG. 9, as shown, each of the suction cups 36 include a base 70 and a foot 72 having a center 74 and a peripheral edge 76. The base 70 is secured to the vertical support member 30 by a threaded engagement or other coupling. A suction cup locking mechanism 84 may include a lever 86 pivotally mounted to the base 70. A linkage member 88 extends from the lever 86 to the foot 72 of the suction cup 36 proximate the peripheral edge 76. The suction cup locking mechanism 84 provides a locking levered position wherein the suction cup 36 is held against the surface S, and a releasing levered position wherein the suction cup 36 is drawn away from the surface S.

In operation, the position of the mini-trampoline 10 may be secured with the suction cups 36 applying suction forces against the surface S. More particularly, upon the lever 86 being pivoted as shown by arrow L, in one levered position, a force is exerted by linkage member 88 to hold the peripheral edge 76 of the foot 72 of the suction cup 36 against the surface S. On the other hand, in another levered position, upon the lever 86 being pivoted as shown by arrow U, a force is exerted by the linkage member 88 to draw the peripheral edge 76 of the foot 72 of the suction cup 36 away from the surface S to which it is adhering until the suction maintaining the suction cup 36 in position is released. The suction cup locking mechanism 84, as presented herein, provides grasping of the peripheral edge 76 of the foot 72 of the suction cup 36 and a mechanical advantage with respect to the forces necessary to hold and release the suction against the surface S as the suction cup 36 is maintained in place or released, respectively.

More generally, during operation, when locked, the suction cups 36 ensure good static friction against lateral forces that can mitigate against variations in the surface S. With the position of the mini-trampoline 10 fixed by way of the suction cups 36, the mini-trampoline 10 is ready for a user to utilize the mini-trampoline 10 for recreation or exercise. The user may appropriately adjust the height of the support assembly 40 and the placement of the T-shaped support bar 56, which is adjustably telescoping from the support segment 48. The user may use the hand knob assembly 64 to adjust the height. With the height of the support assembly 40 appropriately adjusted, the user may use the support assembly 40 and, in particular, the riser bar 68 and one of the handles 58, 60 to mount the mini-trampoline 10 and stand in the center 18 of the trampoline mat 12. The user may then rest the user's hands on the riser bar 68 or hold onto the handles 58, 60 as needed during rebounding. The support assembly 40 aids the user in maintaining balance during use and the support assembly 40 aids the user in getting on and off of the mini-trampoline 10. That is, the mini-trampoline 10 offers recreational enjoyment and exercise. The mini-trampoline 10 safeguards people of various ages and physical abilities with increased accessibility before and after use as well as increased stabilization during use. The mini-trampoline 10 is effective, compact, and an easily storable device.

Figure 10:
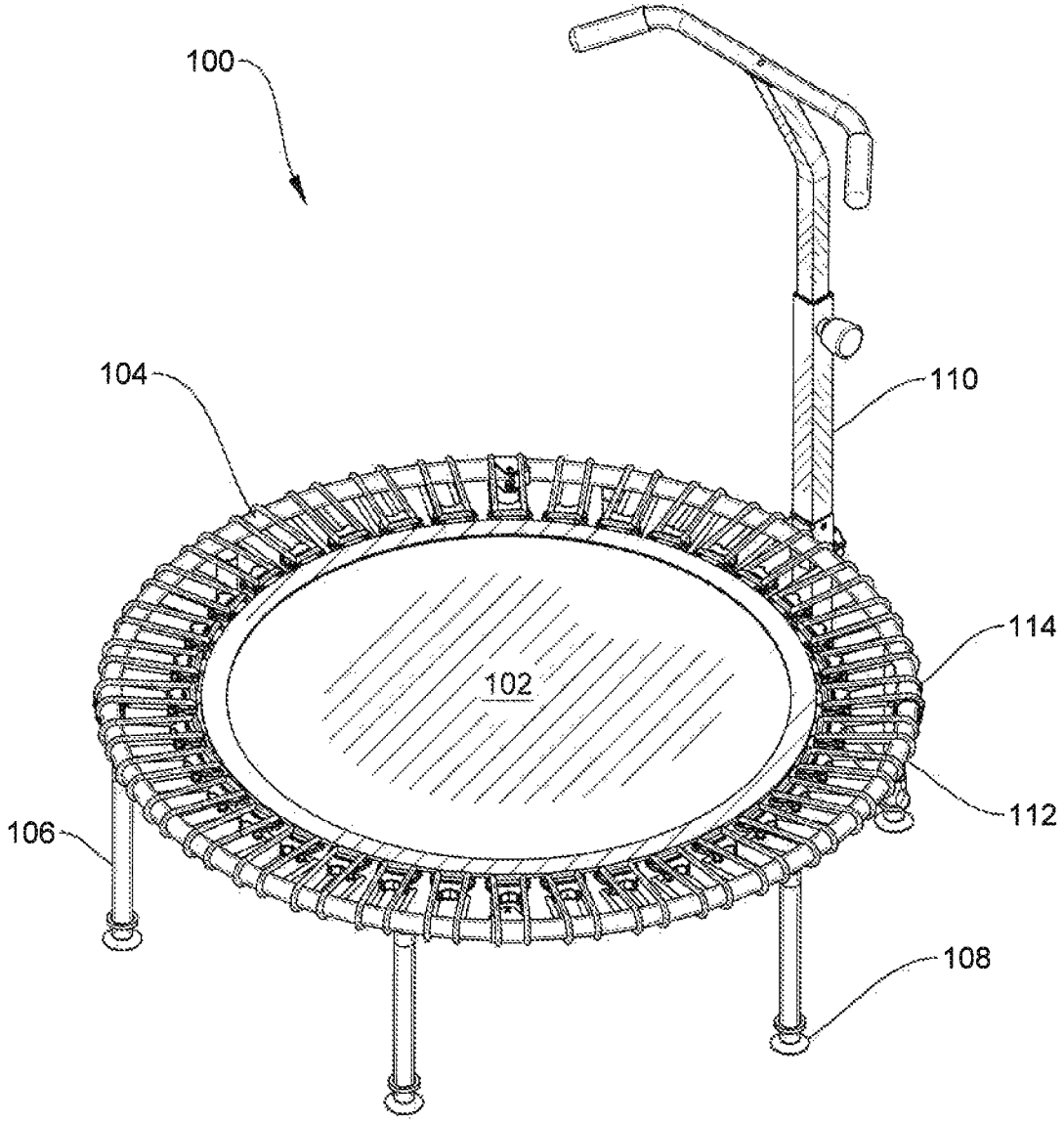
FIG. 10 is a front perspective view of another embodiment of a mini-trampoline, according to the teachings presented herein.

Referring now to FIG. 10, in another embodiment, a mini-trampoline 100 includes a trampoline mat 102 that has a circular shape as compared to the hexagonal shape of the mini-trampoline 10. It should be appreciated that the shape of the mini-trampoline may vary and various shapes are within the teachings presented herein. A base support frame 112 is circumferentially offset from the trampoline mat 102. In one embodiment, the base support frame 112 includes a horizontal support frame 104 and a vertical support frame 106. Suction cups 108 are secured to the lower ends of the vertical support frame 106. Resilient members 114 circumextend from the trampoline mat 102 to the horizontal support frame 104. A support assembly 110 is secured to the base support frame 112.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A mini-trampoline comprising:

a trampoline mat having a periphery;

a base support frame circumferentially offset from the periphery of the trampoline mat, the base support frame including a horizontal support frame having a plurality of horizontal support members, the base support frame including a plurality of vertical support members each having an upper end and a lower end, each of the plurality of vertical support members at the upper end secured to the horizontal support frame, the plurality of vertical support members extending subjacently from the horizontal support frame;

each of the plurality of vertical support members having a suction cup at the lower end, each of the suction cups including a suction cup locking mechanism, the suction cup locking mechanism providing a first levered position wherein the suction cup is configured to be held against a surface, the suction cup locking mechanism providing a second levered position wherein the suction cup is configured to be drawn away from the surface;

each of the suction cups includes a base and a foot secured thereto, the base being secured to the corresponding vertical support member, the foot having a center and a peripheral edge;

each of the suction cup locking mechanisms includes a lever pivotally mounted to the base and a linkage member extending between the lever and a location proximate to the peripheral edge of the foot of the suction cup;

a plurality of resilient members circumextending from the trampoline mat to the horizontal support frame;

a support assembly including a crossbar secured to a first and a second adjacent vertical support member, the first and the second adjacent vertical support members being two of the plurality of vertical support members, the crossbar being subjacent to the horizontal support frame;

the support assembly including a support segment extending vertically from the crossbar and upward away from the horizontal support frame, the support segment being coupled to the horizontal support frame; and the support assembly including a T-shaped support bar adjustably telescoping from the support segment and cantilevering toward the trampoline mat, the T-shaped support bar having a first and a second handle coupled thereto.

2. The mini-trampoline as recited in claim 1, wherein each of the suction cup locking mechanisms further comprises:

in the first levered position, a force is exerted by the linkage member to hold the peripheral edge of the foot of the suction cup against the surface; and in the second levered position, a force is exerted by the linkage member to draw the peripheral edge of the foot of the suction cup away from the surface to which it is adhering until a suction maintaining the suction cup in position is released.

3. The mini-trampoline as recited in claim 1, wherein the trampoline mat further comprises a shape selected from the group consisting of hexagons and circles.

4. The mini-trampoline as recited in claim 1, wherein the T-shaped support bar further comprises:

a first support bar member configured to adjustably telescope from the support segment; and a second support bar extending from the first support bar at an angle, the second support bar having a riser bar secured thereat with the first and the second handles coupled thereto.

5. The mini-trampoline as recited in claim 1, wherein the T-shaped support bar spans from the first adjacent vertical support member to the second adjacent vertical support member proximately above the periphery of the trampoline mat.

6. The mini-trampoline as recited in claim 1, wherein the support assembly further comprises at least three points of contact with the base support frame.

7. A mini-trampoline comprising:

a trampoline mat having a periphery;

a base support frame circumferentially offset from the periphery of the trampoline mat, the base support frame including a horizontal support frame having a plurality of horizontal support members, the base support frame including a plurality of vertical support members each having an upper end and a lower end, each of the plurality of vertical support members at the upper end secured to the horizontal support frame, the plurality of vertical support members extending subjacently from the horizontal support frame;

each of the plurality of vertical support members having a suction cup at the lower end, each of the suction cups including a base and a foot secured thereto, the base being secured to the corresponding vertical support member, the foot having a center and a peripheral edge;

each of the suction cups having a suction cup locking mechanism including a lever pivotally mounted to the base and a linkage member extending between the lever and a location proximate to the peripheral edge of the foot of the suction cup;

wherein in a first levered position, a force exerted by the linkage member is configured to hold the peripheral edge of the foot of the suction cup against a surface;

wherein in a second levered position, a force exerted by the linkage member is configured to draw the peripheral edge of the foot of the suction cup away from the surface to which it is adhering until a suction maintaining the suction cup in position is released;

a plurality of resilient members circumextending from the trampoline mat to the horizontal support frame;

a support assembly including a crossbar secured to a first and a second adjacent vertical support member, the first and the second adjacent vertical support members being two of the plurality of vertical support members, the crossbar being subjacent to the horizontal support frame;

the support assembly including a support segment extending vertically from the crossbar and upward away from the horizontal support frame, the support segment being coupled to the horizontal support frame; and the support assembly including a T-shaped support bar adjustably telescoping from the support segment and cantilevering toward the trampoline mat, the T-shaped support bar having a first and a second handle coupled thereto.

* * * * *